US010252853B2

(12) United States Patent
Zanetti

(10) Patent No.: US 10,252,853 B2
(45) Date of Patent: Apr. 9, 2019

(54) CAPSULE FOR THE PREPARATION OF BEVERAGES

(71) Applicant: Hausbrandt Trieste 1892 SPA, Nervesa della Battaglia (TV) (IT)

(72) Inventor: Fabrizio Zanetti, Villorba (IT)

(73) Assignee: HAUSBRANDT TRIESTE 1892 S.P.A., Nervesa Della Battaglia (Treviso) (IT)

( * ) Notice: Subject to any disclaimer, the term of this patent is extended or adjusted under 35 U.S.C. 154(b) by 0 days.

(21) Appl. No.: 14/418,129

(22) PCT Filed: Jul. 24, 2013

(86) PCT No.: PCT/IB2013/056058
§ 371 (c)(1),
(2) Date: Jan. 29, 2015

(87) PCT Pub. No.: WO2014/020491
PCT Pub. Date: Feb. 6, 2014

(65) Prior Publication Data

US 2015/0197394 A1 Jul. 16, 2015

(30) Foreign Application Priority Data

Jul. 30, 2012 (IT) ..... TV2012A0146

(51) Int. Cl.
*B65D 85/804* (2006.01)

(52) U.S. Cl.
CPC ..... *B65D 85/8043* (2013.01)

(58) Field of Classification Search
CPC ..... B65D 85/8043; B65D 85/8046; B65D 85/804
(Continued)

(56) References Cited

U.S. PATENT DOCUMENTS 2,778,739 A * 1/1957 Rodth ..... 426/77
5,472,719 A * 12/1995 Favre ..... 426/77
(Continued)

FOREIGN PATENT DOCUMENTS

CN 1612831 A 5/2005
EP 1608569 12/2005
(Continued)

OTHER PUBLICATIONS

Dionne, Suzanne. Coffee Detective. Oct. 14, 2008. Retrieved from Internet URL: <http://www.coffeedetective.com/can-i-recycle-my-keurig-kcups.html>.*
(Continued)

*Primary Examiner* — Erik Kashnikow
*Assistant Examiner* — Ashley Axtell
(74) *Attorney, Agent, or Firm* — Fredrikson & Byron, P.A.

(57) ABSTRACT

A capsule for the preparation of a beverage from a powdery or granular raw material comprises a body of polymeric material, provided with a seat suitable for containing the powdery or granular raw material. The seat has an opening provided with a top edge. The capsule is characterized in that it comprises a permeable foil provided on the top edge for closing the opening of the seat; and a first sealing foil provided on said permeable foil and suitable for being removed before using the capsule.

23 Claims, 3 Drawing Sheets

(58) Field of Classification Search
USPC ..... 426/77, 78, 79, 80, 81, 82, 83, 84
See application file for complete search history.

(56) References Cited

U.S. PATENT DOCUMENTS

| | | | | |
|---|---|---|---|---|
| 7,552,672 | B2 * | 6/2009 | Schmed | 99/295 |
| 7,624,673 | B2 * | 12/2009 | Zanetti | 99/295 |
| 2003/0172813 | A1 * | 9/2003 | Schifferle | A47J 31/0673 99/275 |
| 2005/0150390 | A1 * | 7/2005 | Schifferle | B65D 85/8043 99/295 |
| 2006/0019000 | A1 * | 1/2006 | Zanetti | B65D 85/8043 426/112 |
| 2009/0007796 | A1 * | 1/2009 | Ricotti | 99/295 |
| 2009/0235827 | A1 * | 9/2009 | Bongers et al. | 99/316 |
| 2011/0041702 | A1 | 2/2011 | Yoakim et al. | |
| 2011/0244108 | A1 * | 10/2011 | Rabin | 426/589 |
| 2012/0058226 | A1 * | 3/2012 | Winkler | A47J 31/3695 426/79 |
| 2013/0164414 | A1 * | 6/2013 | Hermanowski | B65D 65/466 426/81 |
| 2014/0161936 | A1 * | 6/2014 | Trombetta et al. | 426/77 |

FOREIGN PATENT DOCUMENTS

| | | | | |
|---|---|---|---|---|
| WO | 03082065 | A1 | 10/2003 | |
| WO | 2004087529 | A1 | 10/2004 | |
| WO | 2008047193 | A1 | 4/2008 | |
| WO | WO-2008047193 | A1 * | 4/2008 | B65D 85/8043 |
| WO | 2010016753 | A1 | 2/2010 | |
| WO | WO 2010106516 | A1 * | 9/2010 | B65D 85/8043 |
| WO | WO 2011080022 | A1 * | 7/2011 | B65D 85/8043 |

OTHER PUBLICATIONS

Definiton of "Filter". Dictionary.com Mar. 3, 2007. Retrieved from Internet Archive URL:<https://web.archive.org/web/20070303195654/http://dictionary.reference.com/browse/filter>.*

PCT International Search Report and Written Opinion dated Jan. 8, 2014 for Intl. App. No. PCT/IB2013/056058, from which the instant application is based, 11 pgs.

* cited by examiner

CAPSULE FOR THE PREPARATION OF BEVERAGES

RELATED APPLICATIONS

This application is a 35 U.S.C. 371 national stage filing from International Application No. PCT/IB2013/056058, filed Jul. 24, 2013, and claims priority to Italian Application No. TV2012A000146, filed Jul. 30, 2012, the teachings of which are incorporated herein by reference.

FIELD OF THE INVENTION

The present invention relates to a capsule for the preparation of beverages.

In particular, the present invention relates a single-dose capsule suitable for containing coffee in powder form or some other raw material in powder or granular form intended for the preparation of a beverage.

In the description below particular reference will be made to capsules containing coffee powder, it being clearly understood that the principles of the present invention may also be applied to other alimentary materials generally used in the production of beverages, both by means of percolation and by means of brewing, such as teas or infusions.

BACKGROUND

Capsules for the preparation of beverages, comprising a body of polymeric material obtained in a manner known per se, for example by means of an injection-moulding process, are known. A capsule of this type is described for example in European patent EP 1608569, in the name of the same applicant.

This known capsule comprises a casing with a slightly frustoconical form which may be manufactured, for example, by thermoforming a sheet of food-grade polypropylene or by means of injection-moulding. The casing has a continuous perimetral top edge projecting towards the outside of the capsule in the radial direction and a bottom perimetral edge. The capsule also comprises a bottom provided with at least one hole through which the beverage being prepared may pass.

The top perimetral edge and the bottom perimetral edge are sealed, respectively, with a top foil and a bottom foil, both made of aluminium, or other food grade material known per se. The expression "sealing an edge" is understood as meaning applying a foil to the top edge or bottom edge of the capsule so that there is no fluid communication between the inside and outside of the capsule through this foil. In a manner known per se, in fact, the edges sealed by means of the foils prevent the coffee powder from losing its organoleptic properties as a result of coming into contact with air.

The bottom divides the inside of the capsule into two zones: a first zone which contains the coffee powder, and a second zone inside which the beverage being prepared is temporarily collected.

This type of capsule envisages the use of a machine provided with means for perforating the top foil of the capsule, able to create a plurality of holes through which hot water is injected inside the top chamber at a very high pressure, for example of between 7 and 20 bar.

The second foil of the capsule is perforated by a punch so as to create a kind of spout, just before percolation of the beverage through the holes commences. Owing to the combined effect of the pressurised hot water supplied in the top chamber and the form of the bottom wall, the beverage fills the bottom chamber with a turbulent motion which favours frothing of the fatty substances.

The capsules of this type, although widely used, are not without drawbacks.

In fact, although the top foil is effective for preserving the organoleptic properties of the product contained inside the capsule, suitable perforation means are required in order to allow the water to pass inside the capsule.

Means for perforating the top foil of the capsule provided on the filter holder unit of professional coffee-making machines are known. These perforation means consist of perforating tips which perforate the top foil of the capsule when the filter-holder is fixed to the body of the machine.

Alternatively separate perforation means, of the hand-held type, are known, these allowing the capsule to be perforated before it is inserted inside the filter holder. The operation is not always easy and could give rise to incomplete perforation or tearing of the top foil.

Moreover, once the capsule has been used, separation of the top foil from the capsule body is not always easy since the foil tends to be break in the vicinity of the holes which have been previously formed.

BRIEF SUMMARY OF EMBODIMENTS OF THE INVENTION

The object of the present invention is therefore to overcome, at least partly, the drawbacks of the prior art.

A first task of the present invention is to provide a capsule with which it is no longer required to use the means for perforating the top foil of the capsule.

A second task of the present invention is to facilitate separation of the top foil of the capsule so that the used foil and capsule may be easily disposed of as recyclable waste, by detaching the foil (generally made of aluminium) from the body (generally made of polymeric material).

The object and tasks are achieved with a single-dose capsule for the preparation of a beverage from a powdery or granular raw material, according to claim 1.

BRIEF DESCRIPTIONS OF DRAWINGS

The advantages and characteristic features of the present invention will become clear from the detailed description which follows of a number of examples of embodiment, provided by way of non-limiting illustration, with reference to the accompanying drawings in which.

DETAILED DESCRIPTION OF EMBODIMENTS OF THE INVENTION

Figure 1:
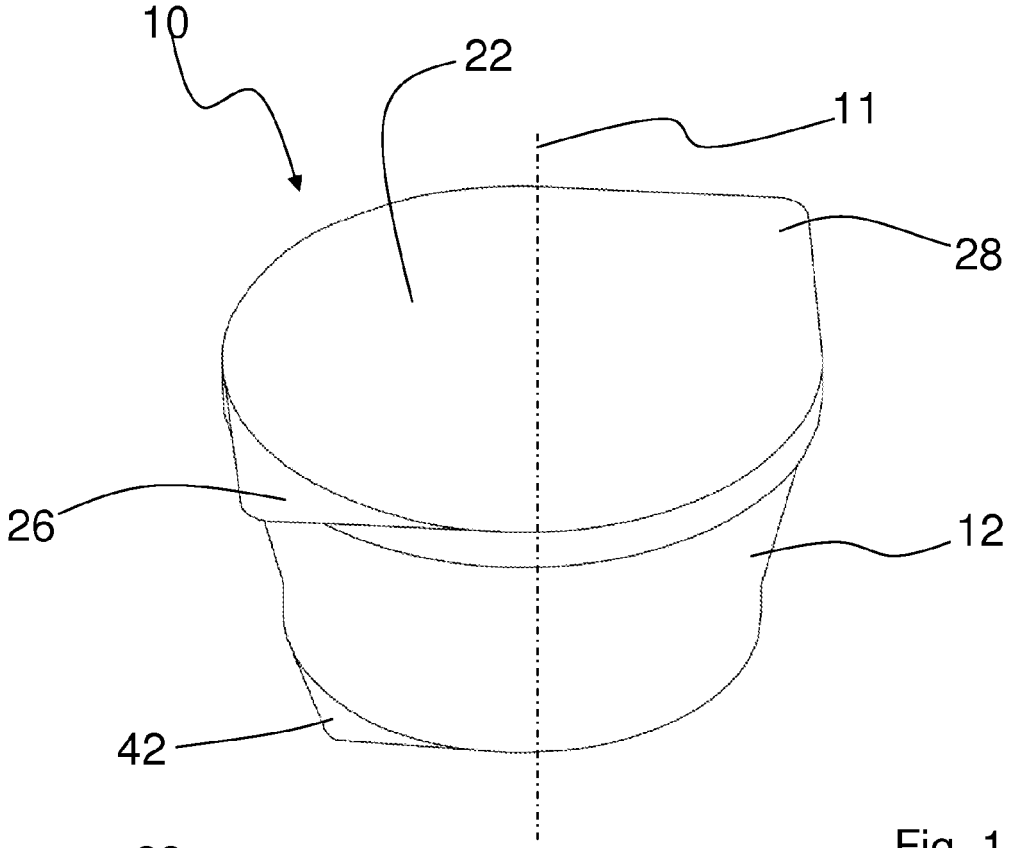
FIG. 1 shows a perspective view of a capsule according to the present invention.

With reference to FIG. 1, an axial direction, parallel to the direction of the main axis 11 of the capsule, is defined.

Figure 2:
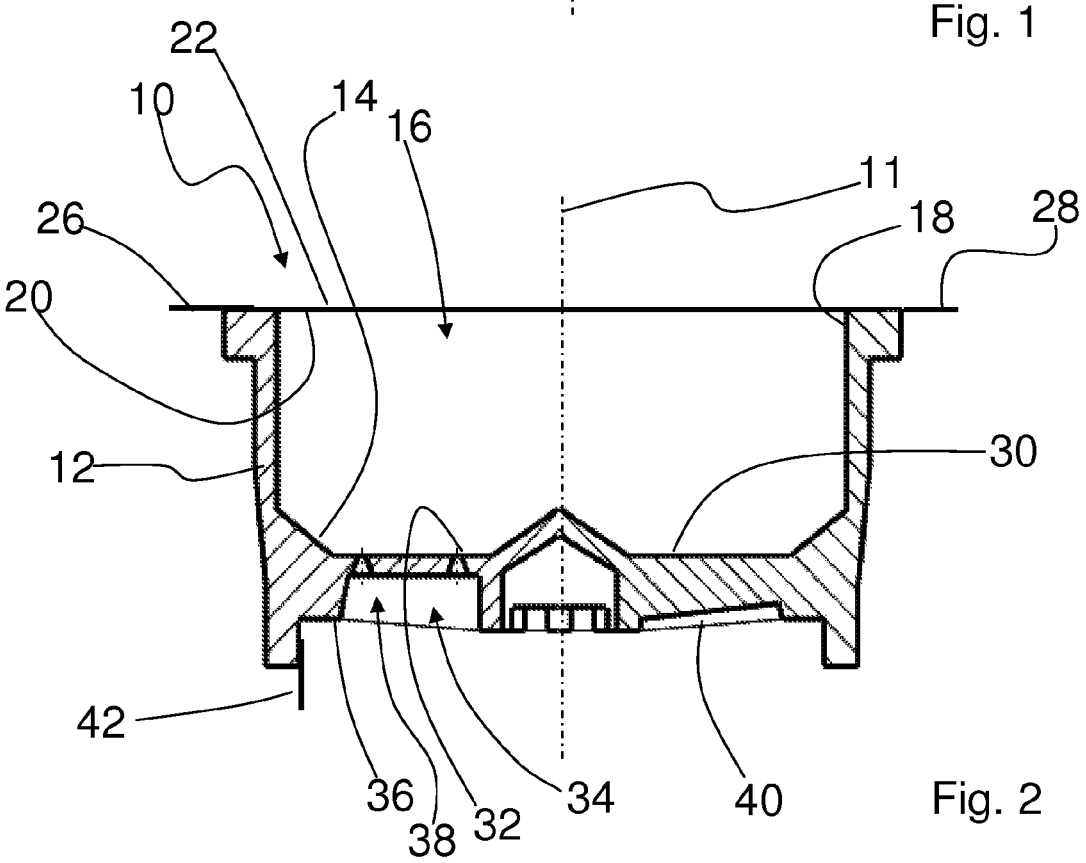
FIG. 2 shows a cross-sectional view along a longitudinal plane of the capsule shown in FIG. 1.

In FIG. 1 it is shown a capsule 10 for the preparation of a beverage from a powdery or granular raw material according to the present invention. The capsule comprises a body 12 made of polymeric material and provided with a seat 14 suitable for containing the powdery or granular raw material. As shown with reference to FIGS. 1 and 2, the body 12 has a frustoconical form, and the seat 14 has an opening 16 provided with a top edge 18.

The capsule is characterized in that it comprises:

a permeable foil 20 provided on the top edge 18 for closing the opening 16 of the seat 14; and a first sealing foil 22 provided on the permeable foil 20 and suitable for being removed before using the capsule 10.

The permeable foil 20 is suitable for allowing water to be supplied to the seat, preventing at the same time the powder or granular substance contained inside the seat 14 from coming out of the capsule 10.

Figure 4:
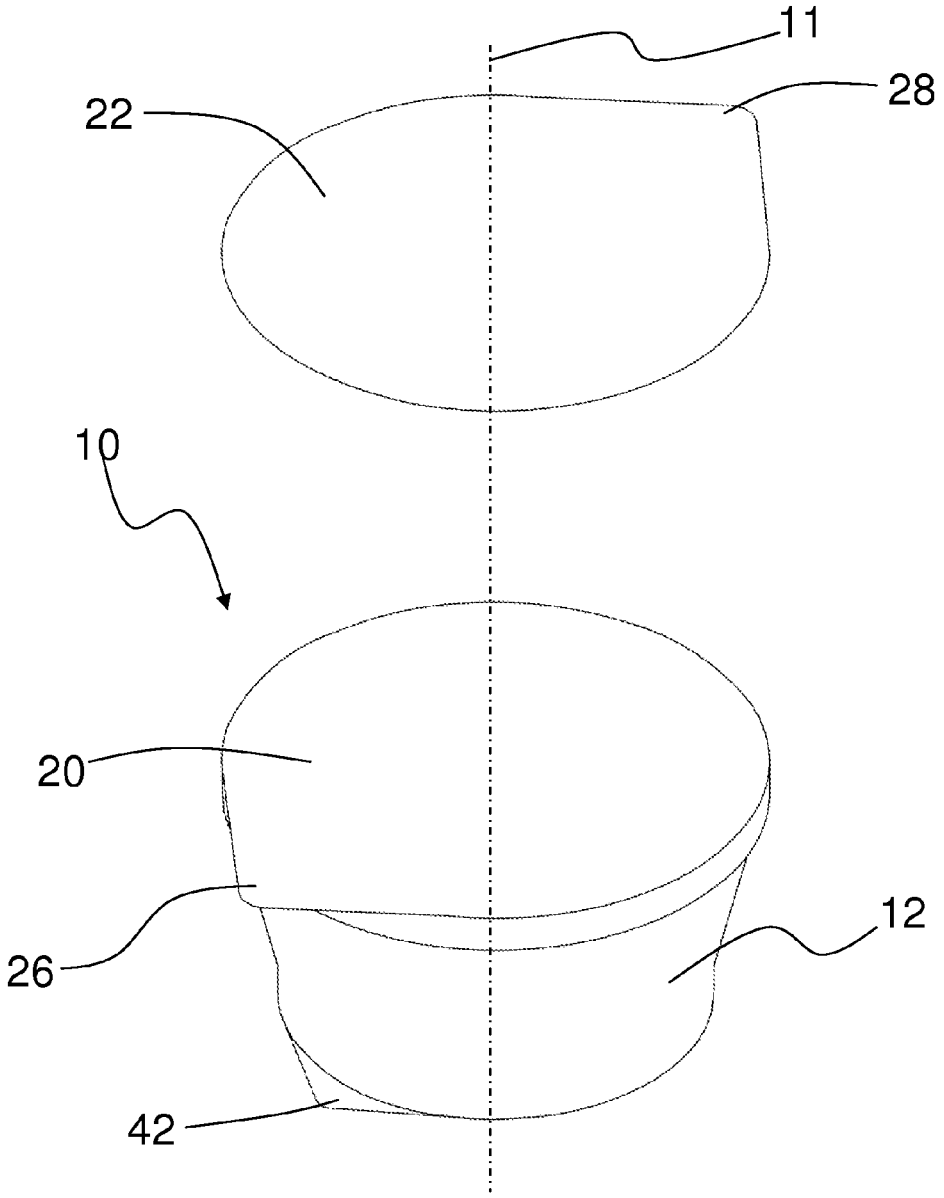
FIG. 4 shows a partially exploded perspective view of a second embodiment of a capsule according to the present invention.

According to a possible embodiment of the present invention, shown in FIG. 4, the permeable foil 20 is made of paper. Advantageously the paper from which the permeable foil is made is that commonly used as filter paper for herbal teas.

Advantageously, the paper used has the following characteristics:

grammage of between 15 g/m$^2$ and 30 g/m$^2$;

thickness of between 50 μm and 80 μm;

dry tensile strength SL>15 N/15 mm;

dry tensile strength ST>5 N/15 mm;

wet paper tensile strength ST>1 N/15 mm; and air permeability >500 l/(m$^2$s).

According to another possible embodiment of the present invention, the permeable foil 20 is made of food-grade filtering fabric.

The permeable foil 20 made of paper or fabric may be glued to the top edge 18.

Figure 3:
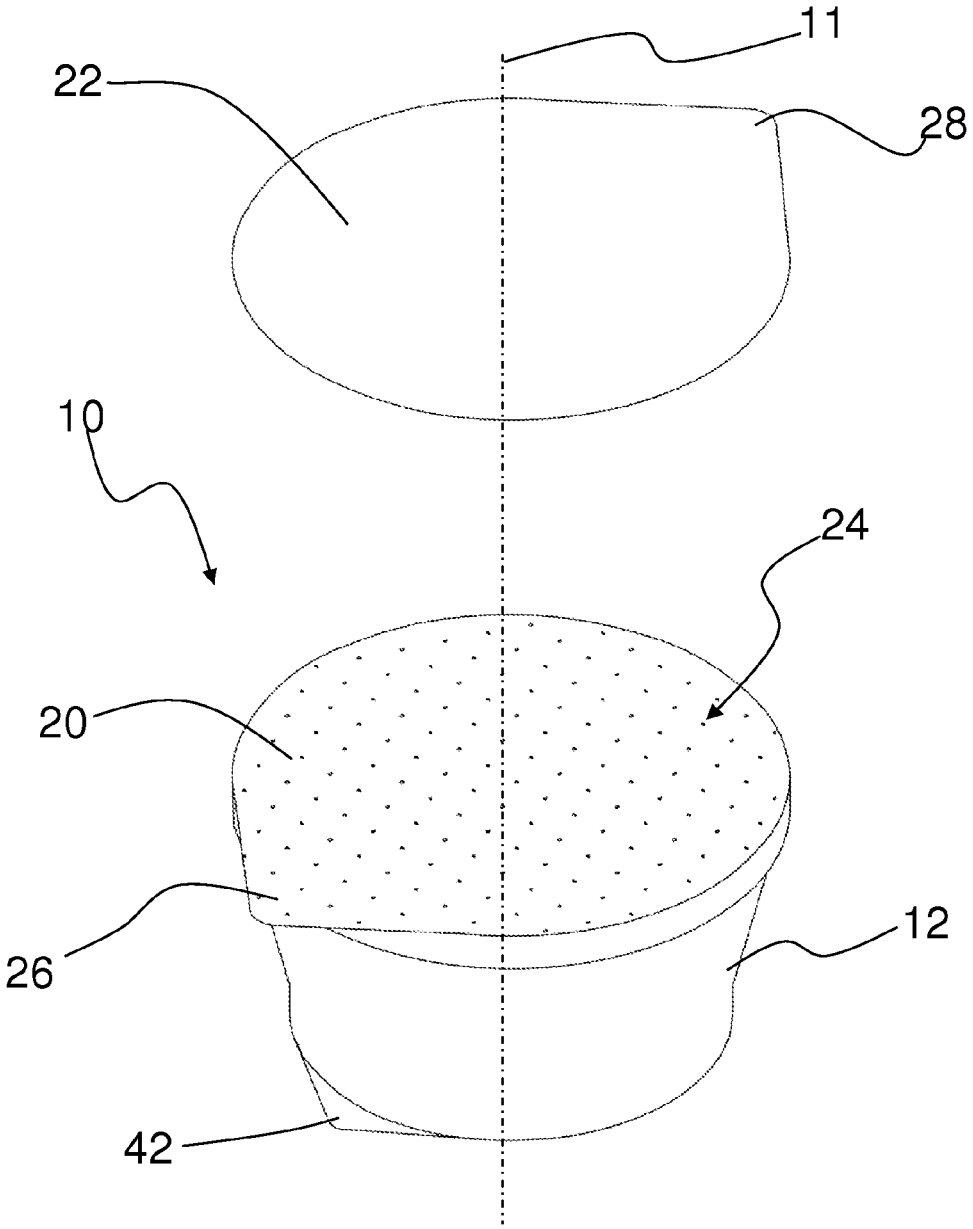
FIG. 3 shows a partially exploded perspective view of a first embodiment of a capsule according to the present invention.

According to an alternative embodiment of the present invention, shown in FIG. 3, the permeable foil 20 is made of polymeric material and is provided with a plurality of holes 24. Advantageously, the polymeric material from which the permeable foil is made is chosen from the group consisting of food-grade or polylaminated polymers.

Advantageously the diameter of the holes may be between 0.5 and 1.5 mm.

The permeable foil 20 of polymeric material may be glued to the top edge 18. Advantageously said permeable foil 20 of polymeric material may be hot-blade welded onto the top edge 18.

According to a possible embodiment of the present invention, the permeable foil 20 is provided with a first tab 26. The first tab 26 facilitates removal of the permeable foil 20 once the capsule 10 has been used.

The first sealing foil 22 is arranged opposite the opening 16 so as to cover the permeable foil 20. The sealing foil is fixed to the capsule 10 so as to prevent fluid communication between the seat 14 and the exterior of the capsule 10. Advantageously the first sealing foil 22 may be fixed to the body 12 of the capsule 10 along the top edge 18.

According to a possible embodiment of the present invention, the first sealing foil 22 is glued to the permeable foil 20 along the top edge 18, and the permeable foil 20 is glued directly onto the top edge 18.

According to an alternative embodiment, the permeable foil 20 is attached to the top edge 18 and also the first sealing foil 22 is attached to the top edge 18 in an outermost position with respect to the permeable foil 20. Advantageously the embodiment described above limits the possibility that separation of the first sealing foil 22 may cause even a partial separation of the permeable foil 20.

According to a possible embodiment of the present invention, the first sealing foil 22 is made of aluminium. According to alternative embodiments of the present invention, the top sealing foil 22 may be made, for example, of polymeric material suitable for preventing fluid communication between the seat 14 and the outside of the capsule 10, so as to preserve the organoleptic properties of the product contained inside the seat 14.

Advantageously, the first sealing foil 22 is provided with a second tab 28. The second tab 28 facilitates removal of the first sealing foil 22.

According to a possible embodiment (shown for example in FIG. 1) the first tab 26 of the permeable foil 20, and the second tab 28 of the first sealing foil 22, when both the foils are attached to the capsule 10, are in diametrically opposite positions.

According to a possible embodiment of the present invention (shown in FIG. 2) the body 12 of the capsule 10 comprises a bottom wall 30 provided with holes 32 for allowing the beverage being prepared to pass through. Advantageously, the bottom wall 30 divides the seat 14 from a bottom chamber 34. The bottom chamber 34 is provided with a bottom edge 36 which defines a bottom opening 38. Advantageously, the bottom opening 38 may be closed by a second sealing foil 40.

According to a possible embodiment of the present invention, the second sealing foil 40 is provided with a third tab 42.

The advantages compared to the capsules of the prior art are therefore evident, both as regards the use of the capsule and as regards the complete recyclability thereof once used.

In fact, in order to use the capsule, it is sufficient to remove the first sealing foil 22 and insert the capsule 10 inside the seat of the machine or the filter holder. Means for perforating the top foil are not necessary since the permeable foil 20 allows the water to pass through and be supplied to the seat 14.

Moreover the recyclability of the capsule 10 improves after it has been used since the first sealing foil may be easily detached because it does not have holes due to the perforation means.

The person skilled in the art may, in order to satisfy specific requirements, make modifications to the embodiments described above and/or replace elements described with equivalent elements, without thereby departing from the scope of the accompanying claims.

The invention claimed is:

1. A capsule for preparation of a beverage from a powdery or granular raw material comprising a body of polymeric material and having frustoconical form, provided with a seat suitable for containing the powdery or granular raw material, said seat having an opening provided with a top edge, characterized in that the capsule comprises:

a permeable foil attached on said top edge for closing said opening of said seat and detachable after use of the capsule, whereby said top edge defines an outermost perimeter of said body; and a first sealing foil provided on top of said permeable foil and detachable in order to enable preparation of the beverage.

2. The capsule according to claim 1, characterized in that said permeable foil is made of food grade paper.

3. The capsule according to claim 1, characterized in that said permeable foil is made of food grade fabric.

4. The capsule according to claim 1, characterized in that said permeable foil is made of a polymeric material and is provided with a plurality of holes.

5. The capsule according to claim 4, characterized in that said body comprises a bottom wall provided with holes, said bottom wall dividing said seat from a bottom chamber having a bottom edge defining a bottom opening, said bottom opening being closed by a second sealing foil.

6. The capsule according to claim 5, characterized in that said second sealing foil is provided with a tab.

7. The capsule according to claim 1, characterized in that said first sealing foil is made of aluminum.

8. The capsule according to claim 7, characterized in that said first sealing foil is provided with a tab.

9. The capsule according to claim 1, characterized in that said permeable foil is provided with a first tab.

10. The capsule according to claim 9, characterized in that said first sealing foil is provided with a second tab.

11. The capsule according to claim 9, characterized in that said body comprises a bottom wall provided with holes, said bottom wall dividing said seat from a bottom chamber having a bottom edge defining a bottom opening, said bottom opening being closed by a second sealing foil.

12. The capsule according to claim 11, characterized in that said second sealing foil is provided with a further tab.

13. The capsule according to claim 1, characterized in that said first sealing foil is provided with a tab.

14. The capsule according to claim 13, characterized in that said body comprises a bottom wall provided with holes, said bottom wall dividing said seat from a bottom chamber having a bottom edge defining a bottom opening, said bottom opening being closed by a second sealing foil.

15. The capsule according to claim 1, characterized in that said body comprises a bottom wall provided with holes, said bottom wall dividing said seat from a bottom chamber having a bottom edge defining a bottom opening, said bottom opening being closed by a second sealing foil.

16. The capsule according to claim 15, characterized in that said second sealing foil is provided with a tab.

17. The capsule according to claim 15, characterized in that said second sealing foil is provided with a further tab.

18. The capsule according to claim 1, characterized in that said body comprises a bottom wall provided with holes, the holes directed to a bottom chamber, the bottom chamber defining the only lower outlet for the beverage from the capsule body.

19. The capsule according to claim 1, characterized in that the top edge defines a singular upper opening for the seat.

20. The capsule according to claim 19, characterized in that the top edge with seat form a singular upper chamber for the capsule.

21. The capsule according to claim 1, characterized in that said permeable foil is permeable over an entire surface of the permeable foil.

22. The capsule according to claim 1, characterized in that said first sealing foil is attached on said top edge at the outermost perimeter of said body.

23. The capsule according to claim 22, characterized in that the permeable foil and the first sealing foil are detachable in same manner.

* * * * *